US011531305B2

(12) United States Patent
Berner et al.

(10) Patent No.: US 11,531,305 B2
(45) Date of Patent: Dec. 20, 2022

(54) VERSATILE HOROLOGY COMPONENT

(71) Applicant: ROLEX SA, Geneva (CH)

(72) Inventors: Detlef Berner, La Conversion (CH); Pierre Di Luna, Geneva (CH); Romain Girod, Annemasse (FR); Alexandre Oliveira, Amancy (FR); Ollivier Pujol, Lausanne (CH); Alexandra Roulet, Geneva (CH)

(73) Assignee: ROLEX SA, Geneva (CH)

( * ) Notice: Subject to any disclaimer, the term of this patent is extended or adjusted under 35 U.S.C. 154(b) by 383 days.

(21) Appl. No.: 16/448,971

(22) Filed: Jun. 21, 2019

(65) Prior Publication Data

US 2019/0391535 A1 Dec. 26, 2019

(30) Foreign Application Priority Data

Jun. 25, 2018 (EP) ..... 18179674

(51) Int. Cl.

| | |
|---|---|
| ***G04G 9/00*** | (2006.01) |
| ***G04G 11/00*** | (2006.01) |
| ***G04G 17/08*** | (2006.01) |

(52) U.S. Cl.

CPC ..... *G04G 9/0041* (2013.01); *G04G 9/0052* (2013.01); *G04G 11/00* (2013.01); *G04G 17/08* (2013.01)

(58) Field of Classification Search

CPC .... G04G 9/0041; G04G 9/0052; G04G 11/00; G04G 17/08

(Continued)

(56) References Cited

U.S. PATENT DOCUMENTS

| | | | | |
|---|---|---|---|---|
| 4,205,522 | A | 6/1980 | Takami | |
| 6,208,591 | B1 * | 3/2001 | Sakurazawa ..... | G04B 19/30 368/67 |

(Continued)

FOREIGN PATENT DOCUMENTS

| | | |
|---|---|---|
| CH | 713 156 A2 | 5/2018 |
| EP | 2 626 401 A1 | 8/2013 |

(Continued)

OTHER PUBLICATIONS

European Search Report and Written Opinion dated Nov. 29, 2018 issued in application No. EP18179672, counterpart of co-pending U.S. Appl. No. 16/448,962 filed concurrently; w/ English machine translation (26 pages) (D1-D5 cited in the European Search Report of the co-pending application and EP2730636A1 cited in the specification of the co-pending application are not listed in this IDS form since they were cited in the European Search Report of this application and listed on another IDS form filed concurrently).

(Continued)

*Primary Examiner* — Kerri L McNally
(74) *Attorney, Agent, or Firm* — WHDA, LLP

(57) ABSTRACT

A horology component (1) for a timepiece, including a first portion (10) and a second portion (20), the first portion (10) comprising one part that is at least partially transparent and at least partially superposed on top of the second portion (20), this second portion (20) taking the form of a massive portion comprising a material capable of emitting at least one emission light wave if excited by at least one excitation light wave, and the at least partially transparent part of the first portion allowing an emission light wave emitted by the second portion (20) to be transmitted at least partially toward the outside of the horology component so that the horology component exhibits at least a first appearance by day and at least one different second appearance by night (Continued)

where the first portion (10) is backlit by an emission light wave emitted by the second portion (20).

20 Claims, 10 Drawing Sheets
(4 of 10 Drawing Sheet(s) Filed in Color)

(58) Field of Classification Search
USPC ..... 368/227
See application file for complete search history.

(56) References Cited

U.S. PATENT DOCUMENTS

| | | | | |
|---|---|---|---|---|
| 9,284,485 | B2 | 3/2016 | Berner et al. | |
| 9,394,480 | B2 | 7/2016 | Berner et al. | |
| 9,915,924 | B2 * | 3/2018 | Sagardoyburu | G04B 19/12 |
| 9,920,245 | B2 | 3/2018 | Berner et al. | |
| 10,196,566 | B2 * | 2/2019 | Berner | C04B 35/481 |
| 2003/0007425 | A1 * | 1/2003 | Amano | G04B 19/32 368/232 |
| 2003/0016315 | A1 * | 1/2003 | Ueno | G02F 1/133617 349/66 |
| 2004/0196742 | A1 * | 10/2004 | Gouthier | G04B 19/32 368/232 |
| 2013/0207040 | A1 | 8/2013 | Berner et al. | |
| 2014/0124702 | A1 | 5/2014 | Berner et al. | |
| 2015/0252260 | A1 | 9/2015 | Berner et al. | |
| 2016/0137919 | A1 | 5/2016 | Berner et al. | |

FOREIGN PATENT DOCUMENTS

| | | |
|---|---|---|
| EP | 2 730 636 A1 | 5/2014 |
| JP | H07-55958 A | 3/1995 |

OTHER PUBLICATIONS

European Search Report and Written Opinion dated Nov. 29, 2018 issued in counterpart application No. EP18179674; w/ English machine translation (24 pages).

* cited by examiner

| | J | N |
|---|---|---|
| Fig. 2a |  |  |
| Fig. 2b |  |  |
| Fig. 2c |  |  |
| Fig. 2d |  |  |

| | I | N |
|---|---|---|
| Fig. 3a |  |  |
| Fig. 3b |  |  |
| Fig. 3c |  |  |
| Fig. 3d |  |  |

| | L [mcd/m²] | | | |
|---|---|---|---|---|
| t [min] | 10 ' | 200 ' | 600 ' | 800 ' |
| 0.0 | 156.2 | 10.47 | 3.19 | 2.23 |
| 0.5 | 152.0 | 10.48 | 3.27 | 2.41 |
| 1 | 112.3 | 7.75 | 2.36 | 1.73 |
| 2 | 25.6 | 2.27 | 0.86 | 0 |
| 2.5 | 10.0 | 1.14 | 0 | 0 |
| 3 | 5.7 | 0 | 0 | 0 |
| 4.5 | 4.0 | 0 | 0 | 0 |

VERSATILE HOROLOGY COMPONENT

This application claims priority of European patent application No. EP18179674.9 filed Jun. 25, 2018, the content of which is hereby incorporated by reference herein in its entirety.

INTRODUCTION

The present invention relates to a versatile horology component. This horology component may be a dial, a dial counter, an index (an hour marker, a numeral marker, or any marker), a bezel disk or, more generally, a decorative plate. The invention also relates to a timepiece, such as a watch, comprising such a versatile horology component.

BACKGROUND ART

There are, in existence, horology components the aesthetic of which changes according to the luminosity in order to create decorative effects, particularly dials. Such horology components traditionally comprise coats of luminescent lacquer. These existing horology components all exhibit disadvantages, including:

- a complex architecture, leading to a manufacturing process that is complex, handling that is tricky, use that is limited and/or an overall cost that is high; and/or
- limited rendition from an aesthetic standpoint.

It is an overall objective of the invention to offer a versatile horology component solution which does not have all or some of the disadvantages of the prior art, and which forms a solution that is an improvement on the existing solutions.

More particularly, one object of the invention is to offer a versatile horology component solution that is simple and makes it possible to achieve an attractive aesthetic effect.

BRIEF DESCRIPTION OF THE INVENTION

To that end, the invention relates to a horology component for a timepiece, which component characteristically comprises a first portion and a second portion, the first portion comprising at least one part that is at least partially transparent and at least partially superposed on top of the second portion, this second portion taking the form of a massive portion comprising a material capable of emitting at least one emission light wave if excited by at least one excitation light wave, and said at least one part of the first portion that is at least partially transparent allowing an emission light wave emitted by the second portion to be transmitted at least partially toward the outside of the horology component so that the horology component exhibits at least a first appearance by day and at least one different second appearance by night where the first portion is backlit by an emission light wave emitted by the second portion. The massive portion advantageously comprises a luminescent material distributed through its volume.

In addition, said part of the first portion is advantageously translucent, allows an excitation light wave coming from outside the horology component to be transmitted at least in part to the second portion but allows the second portion to be visible little if at all by day. It doesn't allow or only allows a little the second portion to be seen by day.

Such a horology component may be a dial, a dial counter, an index (an hour marker, a numeral marker, or any marker), a bezel disk or a decorative plate.

The invention also relates to a timepiece, notably a wristwatch, per se, which comprises such a horology component.

The invention is more specifically defined by the claims.

BRIEF DESCRIPTION OF THE FIGURES

The patent or application file contains at least one drawing executed in color. Copies of this patent or patent application publication with color drawings will be provided by the Office upon request and payment of the necessary fee.

These objectives, features and advantages of the invention will be described in detail in the following description of particular nonlimiting embodiments given with reference to the appended figures, in which:

FIG. 2*a* shows a dial comprising a first portion formed of veined (or banded) pink mother-of-pearl in day configuration (J) and night configuration (N);

FIG. 2*b* shows a dial comprising a first portion formed of manganocalcite in day configuration (J) and night configuration (N);

FIG. 2*c* shows a dial comprising a first portion formed of veined blue chalcedony in day configuration (J) and night configuration (N);

FIG. 2*d* shows a dial comprising a first portion formed of opal in day configuration (J) and night configuration (N);

FIG. 3*a* shows a dial comprising a first portion formed of mahogany obsidian in day configuration (J) and night configuration (N);

FIG. 3*b* shows a dial comprising a first portion formed of ferrite in day configuration (J) and night configuration (N);

FIG. 3*c* shows a dial comprising a first portion formed of jasper in day configuration (J) and night configuration (N);

FIG. 3*d* shows a dial comprising a first portion formed of blue quartz in day configuration (J) and night configuration (N).

DETAILED DESCRIPTION OF PARTICULAR EMBODIMENTS

Figure 1:
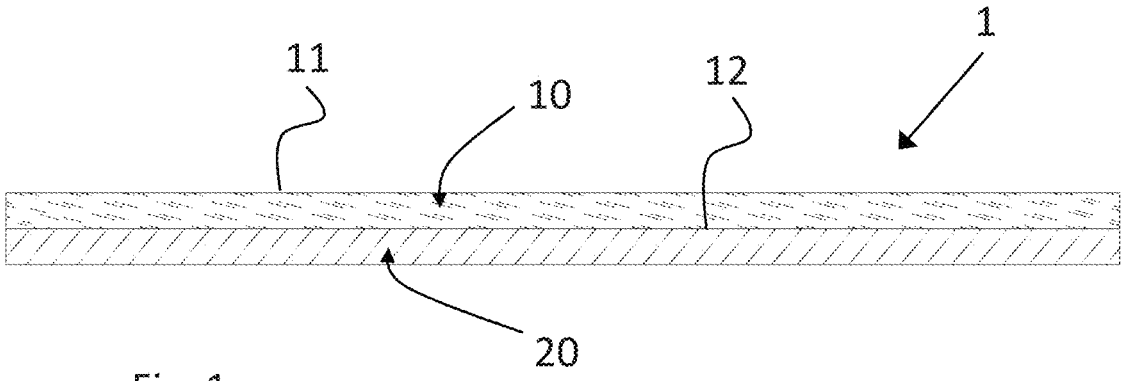
FIG. 1 depicts a schematic view in cross section of a versatile horology component according to one particular alternative form of a first embodiment of the invention.

For the sake of the flow of the description, the same references will be used in the various embodiments for denoting features that are identical or equivalent.

In addition, in order to simplify the description that follows, the adjective "exterior" will be used to refer to a volume or a surface of a horology component that is intended to face toward the outside of a timepiece, notably including a volume or a surface directly visible to an observer looking at the timepiece. By contrast, the adjective "interior" refers to a volume or a surface of a horology component that is intended to face toward the inside of a timepiece with respect to another volume or surface of the same horology component that faces toward the outside.

Furthermore, the adjective "opaque" will be used to refer to the property of a material when the material in question has a transmission of under 10% of light radiation containing, in practice, at least wavelengths in the visible and/or ultraviolet part of the spectrum. An "opaque material" will be considered to mean a material of which the nature, combined with the thickness used, forms an opaque barrier to the above-mentioned light radiation. In the embodiments of the invention, the material of a first portion will be defined as opaque with reference to the wavelengths of light that excite another material of a second portion and/or to the wavelengths of a wave of light emitted by another such excited material, as will be explained in detail hereinafter. Note that the one same material may be opaque when used at a certain thickness, and non-opaque at a lesser thickness. The same term "opaque materials" will be used in the plural for a structure comprising the arrangement of several materials the combination of which meets the conditions explained hereinabove in respect of the definition of an "opaque material". The term "opaque zone" or "opaque part" will be used to refer to a localized part of a component formed of at least one opaque material and which behaves in the way mentioned hereinabove with respect to a radiation, and ultimately prevents any visible effect of a wave of light through said opaque zone or part.

The adjective "transparent" will be used to refer to a material or part of a component which is not opaque, thus covering embodiments that are fully transparent and partially transparent, such as semi-transparent or translucent. The adjective "transparent" will be used to refer to the property of a material when the material in question has a transmission of more than 10% inclusive, of light radiation containing, in practice, at least wavelengths in the visible and/or ultraviolet part of the spectrum. A "transparent material" will be considered to mean a material of which the nature, combined with the thickness used, allows at least partial transmission of the above-mentioned light radiation. In the embodiments of the invention, the material of a first portion will be defined as transparent with reference to the wavelengths of light that excite another material of a second portion and/or to the wavelengths of a wave of light emitted by another such excited material, as will be explained in detail hereinafter. Note that the one same material may be transparent when used at a certain thickness, and non-transparent at a greater thickness. The same term "transparent materials" will also be used in the plural for a structure comprising the arrangement of several materials the combination of which meets the conditions explained hereinabove in respect of the definition of a "transparent material". The term "transparent zone" or "transparent part" will be used to refer to a localized part of a component formed of at least one transparent material and which behaves in the way mentioned hereinabove with respect to a radiation, and ultimately allows any visible effect of a wave of light through said transparent zone or part. Such a transparent part may be obtained by using at least one transparent material, or by using at least one transparent material advantageously combined with a special structuration, as will be described in detail later on, or by using at least one opaque material combined with a special structuration that renders the part at least partially transparent.

The embodiments of the invention are all based on the use of a portion within a horology component capable of emitting light when it is or has been subjected to illumination, notably to external illumination or illumination from any appropriate excitation source, in a certain range of wavelengths, because the portion is made up of a material that is notably phosphorescent and/or fluorescent. Thus, the term "excitation light wave" will be used for illumination in a range of wavelengths that allows excitation of this portion able in return to emit light or lighting: in practice, this range of wavelengths represents all or part of the wavelengths corresponding to the ultraviolet and visible parts of the spectrum. Finally, the term "emission light wave" or "emitted light" will be used to refer to any illumination or emission spectrum that produces an effect, visible to an observer looking at the horology component concerned, particularly at night time or under conditions of reduced light intensity, emitted by said portion following its having received an excitation light wave. Note that for the sake of simplicity, the two opposing situations will be referred to hereinafter as day/night, although the term "night" is not restricted to a situation of total darkness but extends to include periods of partial darkness somewhere between day and night.

Note that an excitation light wave may come from outside and reach the second portion after having passed through the first portion. As an alternative, an excitation light wave may be generated by any other means, notably by an internal light source. By way of example, it could be generated by a light source comprising LEDs, positioned inside a timepiece, under the second portion.

A number of embodiments of the invention will now be described in the context of a horology component intended for a timepiece.

Such a horology component 1 may, for example, be a dial for a timepiece, notably for a wristwatch. It comprises a first portion 10 comprising at least one transparent part, and a second portion 20 able to emit an emission light wave, notably one that is phosphorescent and/or fluorescent, when it is or has been subjected to an excitation light wave within a certain range of frequencies.

The second portion 20 takes the form of a massive portion. A portion is notably considered to be massive when, considered independently of the other portions, it constitutes a solid object which has no structural need for mechanical support in order to support it without deformation.

A second portion such as this advantageously comprises a massive structure incorporating a luminescent material distributed through its volume. What is meant by a luminescent material is a material obtained from any luminescent, phosphorescent and/or fluorescent substance or the like. Such a second portion may have a substantially constant thickness, on average comprised between 0.01 mm and 5 mm. Such a second portion may have a surface area greater than or equal to 1 $mm^2$ or a surface area comprised between 0.01 $cm^2$ and 15 $cm^2$ inclusive. Such a second portion may be a plate made of fluorescent and/or phosphorescent ceramic, notably a composite ceramic based on yttrium-stabilized zirconia and Dy/Eu-doped strontium aluminate, advantageously made of "luminescent zirconia", for example as described in document EP2730636.

The fact that the luminescent material is distributed through the volume allows it to be distributed to all of the zones of the volume, preferably uniformly. The advantages of such a second portion are that it incorporates a large quantity of luminescent material, allowing it to reflect more light than a simple coat of lacquer for example and that it has enough rigidity to give it a mechanical property that allows it to be used as a mechanical support in the construction. In particular, the second portion may form a mechanical support for the first portion and/or a support allowing the horology component to be mounted within a timepiece. The second portion may thus perform the dual role of illuminating by night, namely being able to produce an emission light wave, and of supporting the first portion of the horology component. Through this mechanical property, it is possible to form a horology component comprised of only the two assembled portions. The horology component is thus simplified to the maximum.

A first embodiment of the invention will now be described on the basis of FIGS. 1 to 10 in the context of a horology component intended for a timepiece.

According to the first embodiment, the first portion 10 takes the form of a massive portion. It comprises an exterior surface 11 intended to face toward the outside of a wristwatch and be visible or partially visible to the observer. It additionally comprises an interior surface 12 on the opposite side to and parallel or substantially parallel to the exterior surface. It may have a thickness less than or equal to 2 mm, or even a thickness on average comprised between 0.5 nm and 2 mm inclusive.

The first portion 10 comprises at least one transparent part. The first portion or the part of the first portion may be formed of one or more material(s) selected from the following nonexhaustive list: some mother-of-pearls, particularly black; some fossil materials; tortoiseshell; manganocalcite; lepidolite; petrified wood; coral; amber; pearl; ivory; metal or metal alloy such as platinum or ferrite or meteorite; engineering ceramic based on zirconia and/or alumina, pigmented or otherwise; gemstone; mineral; stone or precious substance of organic origin; sphalerite; fluorite; agate; alexandrite; amethyst; anatase; aventurine; chalcedony; chrysoberyl; chrysoprase; citrine; jasper; tiger's-eye; opal; quartz; spinel; aragonite; azurite; malachite; crocoite; apatite; lazulite; turquoise; aquamarine; beryl; tourmaline; obsidian; or snowflake obsidian.

By way of example, FIG. 1 illustrates a schematic view in cross section of a versatile horology component according to one particular alternative form of the first embodiment of the invention, within which the material that forms the first portion comprises at least one part that is transparent for a first portion having a thickness less than or equal to 2 mm inclusive, or even a thickness comprised between 0.5 nm and 2 mm inclusive, or even between 0.5 nm and 1 mm inclusive, or even between 0.5 nm and 0.8 mm inclusive. Thus, the second portion 20 may be subjected to illumination, notably external illumination, and the light emitted by the second portion 20 may generate an effect visible to an observer looking at the horology component. In this particular alternative form of the first embodiment, such a horology component is advantageously equipped only with two massive or solid portions assembled with one another, for example by bonding.

Figure 2:
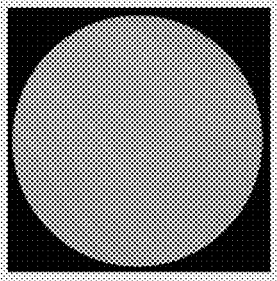
FIGS. 2 and 3 depict photographs, viewed from above, of versatile horology components according to particular alternative forms of the first embodiment of the invention, by day and by night, namely.
Figure 2:
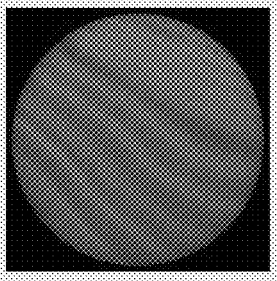
Figure 2:
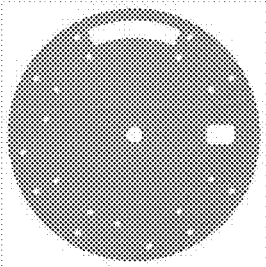
Figure 2:
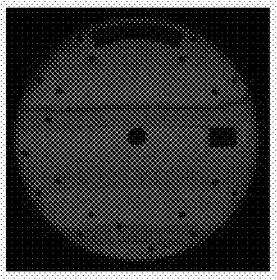
Figure 2:
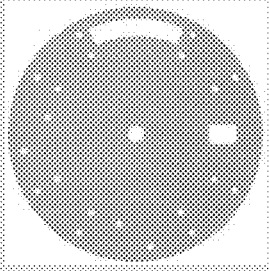
Figure 2:
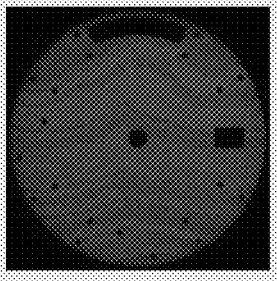
Figure 2:
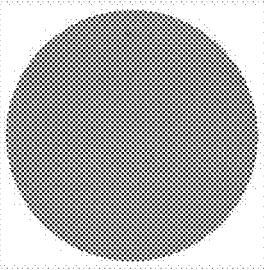
Figure 2:
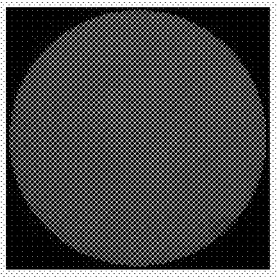

The transparent nature of the first portion may be somewhat variable because of the heterogeneity of the nature of the material of which the first portion is formed. By way of examples, FIG. 2 illustrates, in day configuration (J) and night configuration (N), photos of horology components, particularly dials, respectively comprising first portions formed of veined (or banded) pink mother-of-pearl (FIG. 2*a*), of manganocalcite (FIG. 2*b*), of veined blue chalcedony (FIG. 2*c*) and of opal (FIG. 2*d*).

Figure 3:
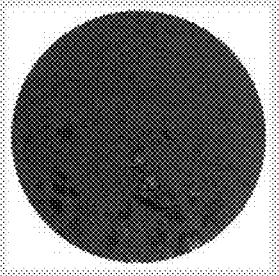
Figure 3:
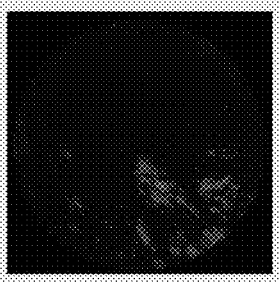
Figure 3:
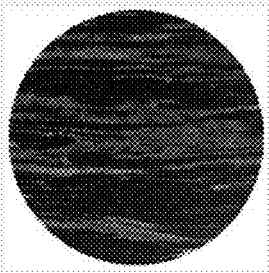
Figure 3:
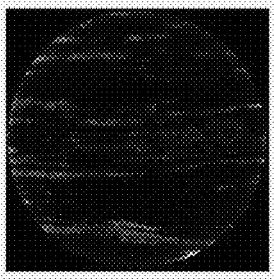
Figure 3:
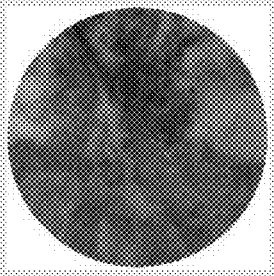
Figure 3:
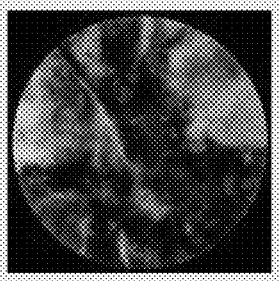
Figure 3:
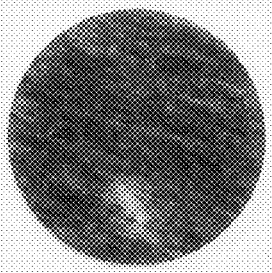
Figure 3:
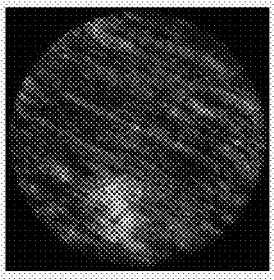

Alternatively, the first portion may comprise at least one transparent part adjoining at least one opaque part. In particular, these parts may be brought about by the intrinsic structure of the material of the first portion, particularly as a result of the heterogeneity of the nature of the material of which the first portion is formed. By way of examples, FIG. 3 illustrates, in day configuration (J) and night configuration (N), photos of horology components, particularly dials, respectively comprising first portions formed of mahogany obsidian (FIG. 3*a*), of ferrite (FIG. 3*b*), of jasper (FIG. 3*c*) and of blue quartz (FIG. 3*d*).

Complementing this, the first portion may comprise at least one structuration 13 able to modify the transparency of at least one transparent part of the first portion. In particular, the first portion may comprise at least one structuration 13 able to modify, notably to enhance, the transparent nature of at least one part of the first portion, thus being able to generate additional visual effects.

Further complementing this, the first portion may comprise at least one structuration 13 able to render transparent at least one opaque part of the first portion, so that the second portion 20 can be subjected to illumination, notably to external illumination, and so that the light emitted by the second portion 20 can generate a visual effect visible to an observer looking at said opaque part of the horology component.

Of course, a structuration may be formed on all or part of a first portion comprising at least one transparent part and/or at least one opaque part.

A "structuration" may be any opening formed on the surface or within the thickness of the first portion. Thus, the term opening 13 may be used to refer to a structuration 13. Such an opening may be blind or open-ended or pass all the way through or represent an internal porosity, which means to say one within the thickness of the first portion. Such an opening may be a micro-opening or a nano-opening, preferably sufficiently small in size so as to be invisible or virtually invisible to the naked eye by day. Alternatively, such an opening may have a larger, macroscopic, dimension, so as to render it intentionally visible. It then also contributes to the decorative effect by day. Alternatively, such a blind opening may be produced on the non-visible face, so as to render it intentionally invisible. It then does not contribute to the decorative effect by day.

In all cases, the openings, whether or not they pass all the way through, may have any cross section, not necessarily circular. This cross section may effectively be rectangular or star-shaped for example.

Alternatively, a structuration may be an at least local modification to the properties of the material of which the first portion is made in all or part of the thickness of said first portion.

Such structuration may be obtained using any conventional machining technique, or by laser machining, notably by femtosecond laser machining or by deep reactive ion etching (DRIE), or else by chemical attack.

Figure 4:
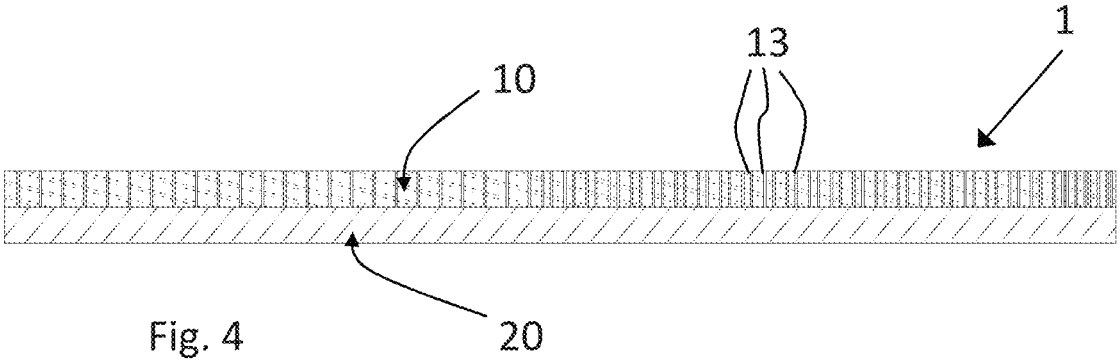
FIG. 4 depicts a schematic view in cross section of a versatile horology component according to one particular way of executing the alternative form of the first embodiment of the invention of FIG. 1.

By way of example, FIG. 4 illustrates a schematic view in cross section of a versatile horology component according to one particular way of executing the alternative form of the first embodiment of the invention illustrated by FIG. 1, in which the material that forms the first portion is transparent for a first portion of thickness representing 2 mm or less, or else a thickness comprised between 0.05 mm and 2 mm inclusive. Thus, the second portion 20 may be subjected to illumination, notably external illumination, and the light emitted by the second portion 20 may generate an effect visible to an observer looking at the horology component.

This horology component can be distinguished from the one depicted in FIG. 1 in that the first portion 10 comprises a structuration 13 taking the form of a number of through-openings. The purpose of these through-openings is to modify, notably to enhance, the transparent nature of the first portion.

In order to do so, the first portion may comprise a sufficient quantity of openings to obtain an additional backlighting effect provided by the luminescent material present in the second portion. The openings 13 in the first portion are, in this instance, micro-openings that pass all the way through or nano-openings that pass all the way through, preferably sufficiently small in size that they cannot be identified by the naked eye. By way of example, these openings may take a substantially cylindrical form with a diameter less than or equal to 60 μm, because it is commonly accepted that from a distance of 20 cm, the eye can perceive details of a size larger than this. In other words, in order for these through-openings not to be visible by day, their dimensions are preferably smaller than the maximum resolving power of the eye under the normal conditions in which a watch is consulted. The resolving power of the eye is approximately one minute of arc length. Finally, these micro-openings allow the light emitted by the second portion 20 to generate an additional visual effect that can be seen by an observer looking at the horology component.

Naturally, the quantity of openings 13, their respective dimensions and their distribution, represent a compromise reached on the basis of the desired aesthetic result. Specifically, the shaping, arrangement and density of the structuration are dependent on the desired effect in terms of a pattern obtained and/or a level of afterglow according to whether it is a fleeting decorative effect or a display lasting several hours that is being sought. This compromise is also dependent on the luminescent material chosen for the second portion. There is therefore a very high number of possibilities. However, it should be noted that micro-openings equivalent to open-ended cylinders or cylinders that pass all the way through with a diameter less than or equal to 100 microns, or even less than or equal to 60 microns, and greater than or equal to a value of the order of 250 nm, the lower size of the openings being that that physically allows the passage of the excitation and/or emission waves, allow the desired objective to be achieved satisfactorily. Of course, the openings may have any geometry suited to the passage of the excitation and/or emission waves.

Figure 5:
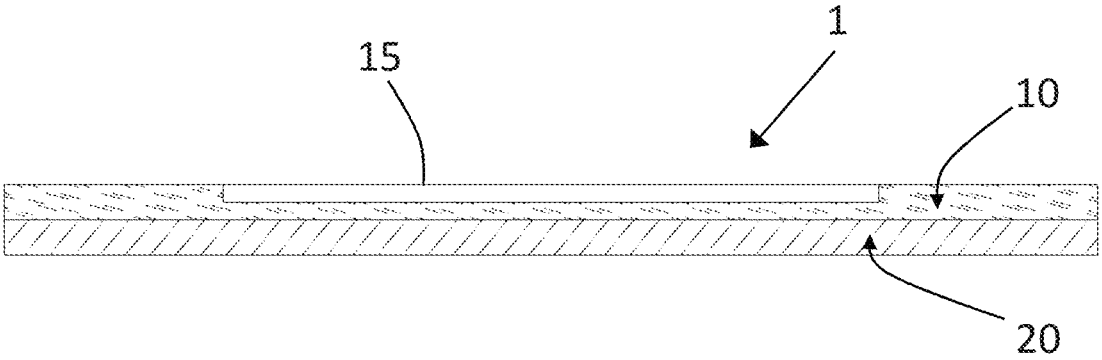
FIG. 5 depicts a schematic view in cross section of a versatile horology component according to one particular way of executing the alternative form of the first embodiment of the invention of FIG. 1.
Figure 6:
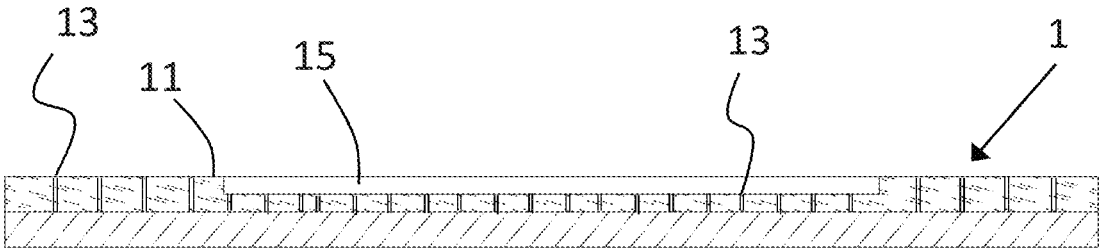
FIG. 6 depicts a schematic view in cross section of a versatile horology component according to one particular way of executing the alternative form of the first embodiment of the invention of FIG. 1.

Of course, it is possible to obtain equivalent, additional or alternative visual effects using at least one blind opening, which is deep enough to encourage the passage of the excitation and emission light waves through the remaining material. This at least one opening may be formed beginning from the exterior surface, as depicted in FIG. 5, or beginning from the interior surface of the first portion. It may have flanks that are straight or inclined. Optionally, this at least one opening may comprise optical means, such as optical fibres, or may be filled with any at least partially transparent material.

In addition or alternatively, the first portion may comprise a structuration that at least locally modifies the transparency properties of the material of which said first portion is made. In other words, various structurations may be combined to create the desired visual effects.

Furthermore, the structuration may be homogeneous; in particular, all the openings may be identical and uniformly distributed over the entire surface of the first portion, in order to form a homogeneous effect. Alternatively, their distribution and/or their geometry may differ within the first portion, to form a heterogeneous effect, which will give a different visual effect. For example, the horology component may comprise blind openings of variable depth, which may evolve according to a gradient. That makes it possible to see a variation in brightness that varies progressively according to the zones of the horology component.

Alternatively, the distribution of the openings is not uniform, as in the particular execution depicted in FIG. 4, but these openings are positioned in such a way as to form a design, which will be perceptible at night, revealed by the backlighting by the luminescent second portion. In that case, the openings may form an aesthetic design, namely a decoration visible by night. According to one advantageous embodiment, this design may, for example, be a pattern, providing not only a decorative effect but also an indication or information of some kind visible by night.

The horology component thus obtained is therefore a versatile horology component because it has at least a first appearance by day, in which the appearance of the component corresponds substantially to the appearance of the first portion, and at least one second appearance by night where the first portion is backlit by a visible emission light wave emitted by the second portion.

There is thus a level of darkness, notably of partial darkness, beyond which the difference between the at least first aspect and the at least second aspect becomes visible. Furthermore, the backlighting may vary according to the intensity of the emission light wave emitted by the second portion; this intensity diminishes over the course of time. Thus, the night-time appearance of the component may evolve. The night-time appearance is different than the daytime appearance. The night-time appearance corresponds to the appearance a first portion that is backlit as long as the material emits. The daytime appearance corresponds substantially to the aspect of a first portion.

In all the embodiments described, including the second and the alternative forms thereof which will be described hereinafter, it is thus advantageous to employ a first portion that is partially transparent, translucent. It is advantageously transparent enough to allow the emission waves of the second portion to pass and to change appearance by night, as a result of backlighting, but sufficiently lacking in transparency for the second portion to be non-visible or barely visible by day. The daytime appearance thus corresponds substantially to that of the first portion. For preference, no zone of the second portion is visible by day; it is therefore completely invisible. This effect can be obtained by combining the degree of transparency of the first portion and the appearance of the second portion.

In the alternative scenario in which all or some of the openings are visible by day, these openings contribute to the daytime aesthetic of the horology component. Furthermore, the night-time aesthetic of the horology component is that of the first portion backlit by the light emitted by the second portion. The horology component thus obtained is therefore a versatile horology component because it has different appearances by day and by night. In particular, it has at least one first appearance by day and at least one second appearance by night.

In alternative forms of the first embodiment, these being illustrated in FIGS. 1, 4, 5 and 6, the horology component according to the invention is equipped only with two massive or solid portions assembled with one another, for example by bonding. Alternatively, the assembly of the two portions of the horology component may be achieved by capillary adhesion. This assembly thus advantageously allows the two portions to be fixed together more or less removably.

As a further alternative, the two portions may be assembled by riveting or crimping or mechanical strapping, notably using at least one ancillary means of assembling two portions, such as a rivet or a ring. As a further alternative, the two portions may be brought into contact and held together by setting.

In particular executions of a horology component according to the first embodiment, a third portion may be provided for modifying, or even sublimating, the visual effects generated by the second portion of said horology component, and therefore modifying the daytime and/or night-time aesthetic of the horology component. This third portion may be interposed between the first and the second portion. This third portion may, for example, take the form of a mask which limits the transmission of light whatever the structuration of the first portion situated above it. This third portion may also take the form of a layer, for example the form of a fluorescent layer, which can be excited by the second portion. Advantageously, such a third portion may be intended to contribute to the function of assembling the first and second portions of said horology component.

Figure 7:
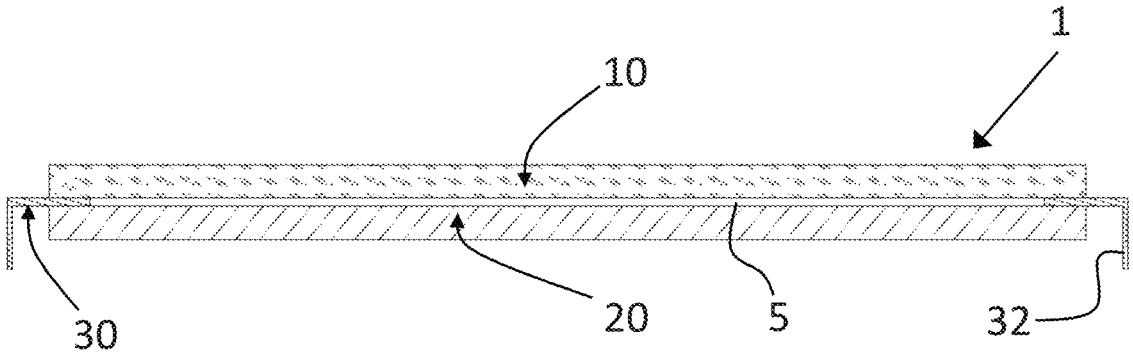
FIG. 7 depicts a schematic view in cross section of a versatile horology component according to another alternative form of the first embodiment of the invention.
Figure 8:
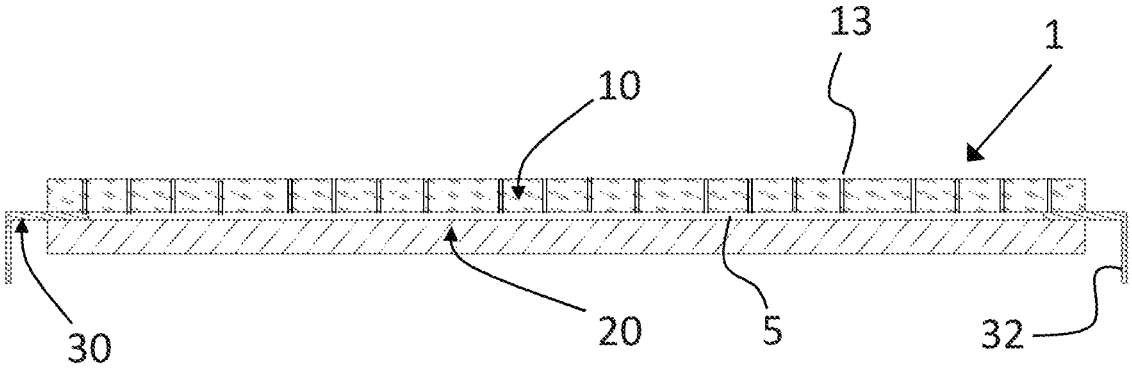
FIG. 8 depicts a schematic view in cross section of a versatile horology component according to one particular way of executing the alternative form of the first embodiment of the invention of FIG. 7.

By way of example, FIGS. 7 and 8 illustrate one way of executing such a horology component. The third portion 30 is interposed between the two first portions, at the circumference thereof, so as to form a skirt comprising an inward extension 32 intended for the fixing of the horology component. In the central part, the two portions 10, 20 are superposed but not in contact, being separated by a space 5 corresponding to the thickness of the third portion 30. Thus, advantageously, this third portion makes it possible to modify the day time and/or night time aesthetic of the horology component by keeping the first and second portions some distance apart. In the embodiment of FIG. 7, the first portion comprises just one or several transparent materials and has no structuration 13. In the embodiment of FIG. 8, the first portion additionally has a structuration 13.

Figure 9:
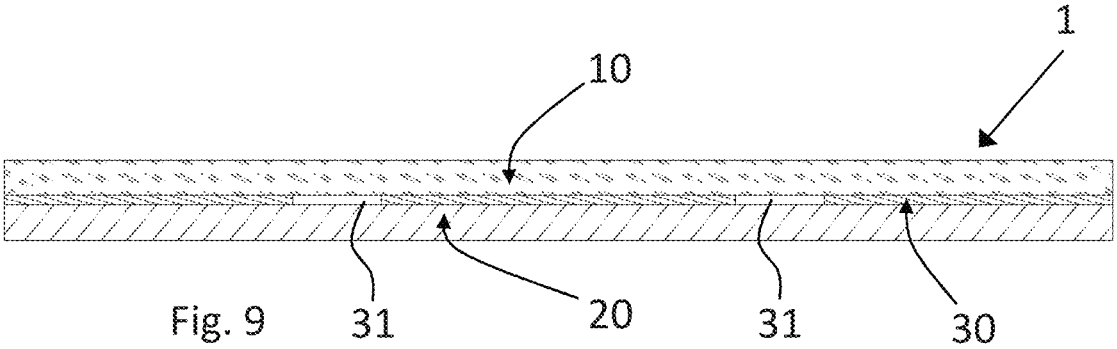
FIG. 9 depicts a schematic view in cross section of a versatile horology component according to another alternative form of the first embodiment of the invention.
Figure 10:
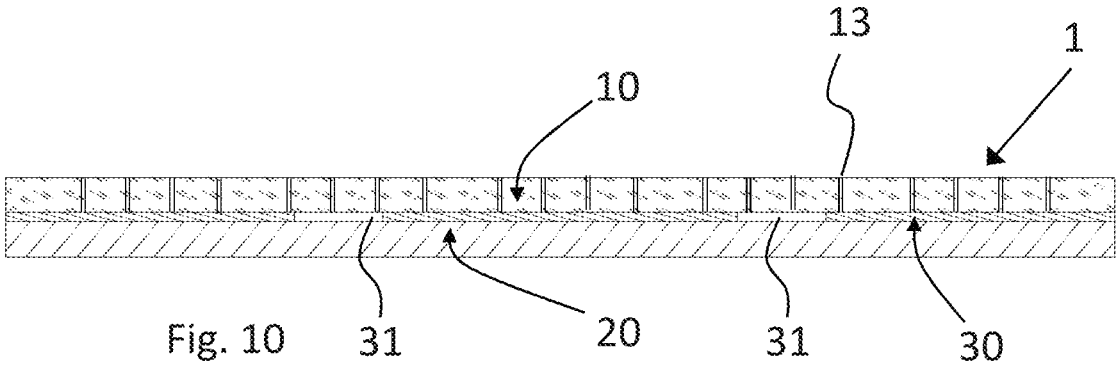
FIG. 10 depicts a schematic view in cross section of a versatile horology component according to one particular way of executing the alternative form of the first embodiment of the invention of FIG. 9.

FIGS. 9 and 10 illustrate another way of executing such a horology component, in which a third portion 30 takes the form of a decorative mask incorporated between the two first portions 10, 20 of the horology component.

This mask may be opaque and have openings 31 that allow the backlighting from the second portion to pass, these openings 31 possibly forming a decorative design. Thus, advantageously, this third portion makes it possible to modify the daytime and/or night-time aesthetic of the horology component. Advantageously also, this third portion may comprise optical means for modifying the backlighting from the second portion, such as optical fibres for example.

Advantageously also, this third portion may take the form of a layer, for example the form of a fluorescent layer, which can be excited by the second portion. In the embodiment of FIG. 9, the first portion comprises just one or several transparent materials and has no structuration 13. In the embodiment of FIG. 10, the first portion additionally has a structuration 13.

According to a second embodiment, the first portion 10 takes the form of a coating applied to the exterior surface of the second portion 20. Thus, the horology component according to the second embodiment may take the form of a one-piece horology component, rather than of two distinct elements which have been assembled, in a more or less removable manner. Note that in this second embodiment the second portion is still massive as described in the first embodiment. FIGS. 11 to 18 are possible depictions thereof. It still advantageously comprises a luminescent material distributed through its volume.

The thickness of this coating is such that the material(s) of which it is made is transparent. A structuration 13, such as, for example, a structuration based on micro-openings or on nano-openings, may be made in this coating, as explained hereinabove. The coating may be made up of metals, metal alloys, polymers, lacquers, varnishes, enamels, ceramics, vitreous ceramics, or hybrid materials. The coating may be applied by any means, such as by physical vapor deposition (PVD), by chemical vapor deposition (CVD), by atomic layer deposition (ALD), by spraying (that allows a liquid to be vaporized into fine droplets under the effect of excess air pressure), using a sol-gel process, etc. Any other procedure known to those skilled in the art for applying a coating may be envisioned.

Figure 11:
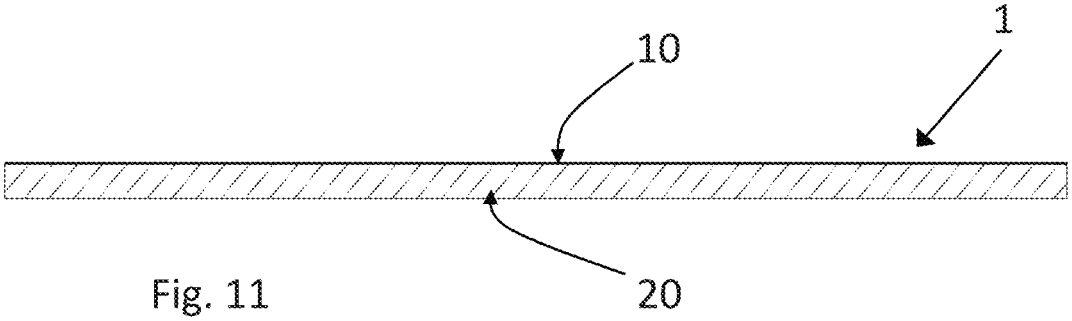
FIG. 11 depicts a schematic view in cross section of a versatile horology component according to an alternative form of a second embodiment of the invention.

FIG. 11 depicts one particular alternative form of the second embodiment, in which the first portion 10 takes the form of a coating of constant thickness applied to the exterior surface of the second portion 20. Thus, the horology component according to this particular alternative form of the second embodiment takes the form of a one-piece horology component, rather than of two distinct elements which have been assembled, in a more or less removable manner. Such a coating may, for example, be a metallic coating of platinum. Advantageously, such a coating has a thickness less than or equal to 50 μm, or even less than or equal to 10 μm or even less than or equal to 1 μm or even less than or equal to 10 nm.

Figures 12, 13:
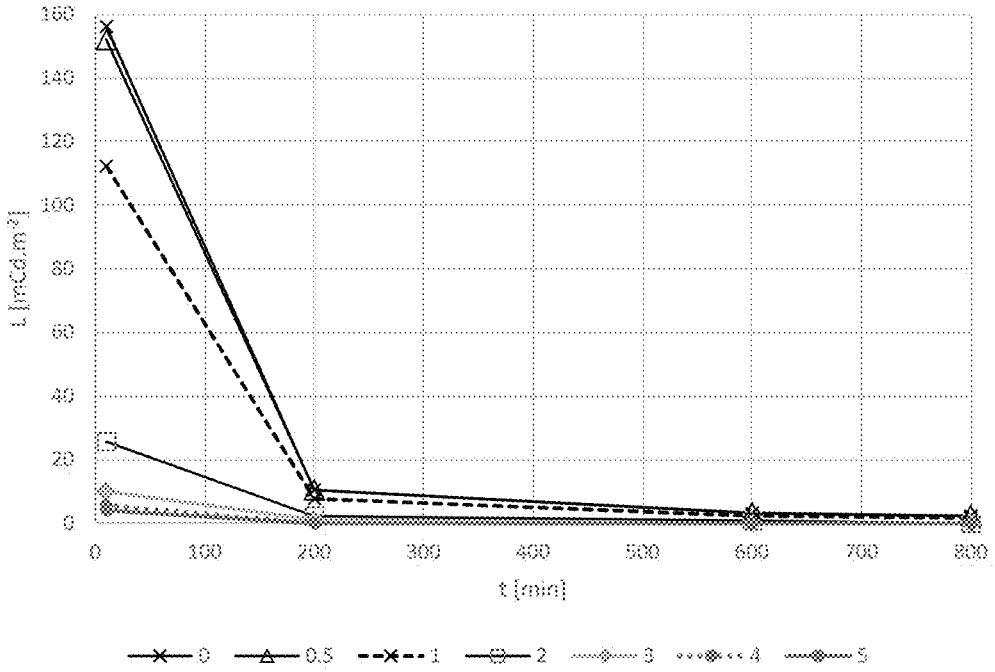
FIG. 12 is a table summarizing measurements of the afterglow, as a function of time and as a function of thickness, of first portions produced according to a second embodiment of the invention.
FIG. 13 depicts the measurements from FIG. 12, in the form of a graph.

FIGS. 12 and 13 summarize, for example, measurements of afterglow of several components produced according to the method already described in patent EP2626401B1, the second portion of which takes the form of luminescent zirconia and which are respectively coated with a layer of platinum applied using ALD the thickness of which varies between 0.5 nanometers and 4.9 nanometers. The thinnest layers barely alter the color and afterglow of the substrate on which they are applied. The thickest layers in this example modify the color and the appearance (which becomes metallic) and the afterglow of the substrate on which they are applied (the luminance drops to zero in as little as a few minutes). The table in FIG. 12 collates the values of the afterglow measurements taken for coatings of different thicknesses E (in nanometers). The afterglow is expressed as a luminance (denoted L) in $mCd/m^2$ (with a precision of ±5%), and is measured after a discharge time t given in minutes. The graph in FIG. 13 plots these values of L as a function of t for each of the coating thicknesses characterized. A comparison is made against the reference which consists of luminescent zirconia without a coating (E=0 nm).

Figure 14A:
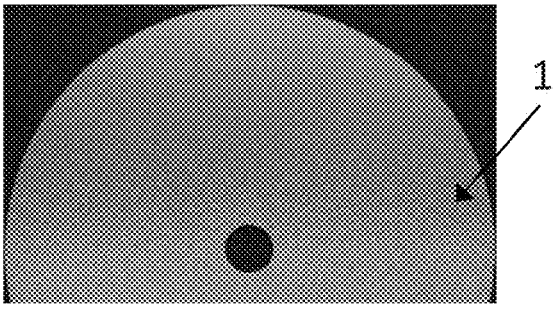
FIGS. 14*a* and 14*b* depict the appearances, by day and by night respectively, of a versatile horology component according to an alternative form of the second embodiment of the invention.
Figure 14B:
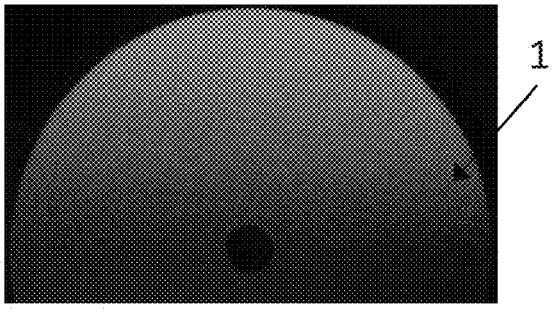

FIGS. 14*a* and 14*b* depict another particular alternative form of a horology component according to the second embodiment, in which the first portion 10 takes the form of a coating of variable thickness applied to the exterior surface of the second portion 20. The thickness of the coating varies within the thickness range comprised between 0 and 100 nm. More particularly, the first portion 10 takes the form of a titanium coating the thickness of which varies so as to form grey shading. In order to do that, the titanium coating is ablated using a femtosecond laser, with progressively increasing degrees of ablation, in order to create grey shading, that the observer may or may not be able to perceive by day. FIG. 14*a* depicts the horology component by day, which has a shaded metallic grey appearance, and FIG. 14*b* depicts the same horology component by night, where it has a luminous appearance the intensity of which varies according to the aforementioned shading. What is meant here by "ablation" is an at least local thinning of the coating that forms the first portion 10.

Figure 15:
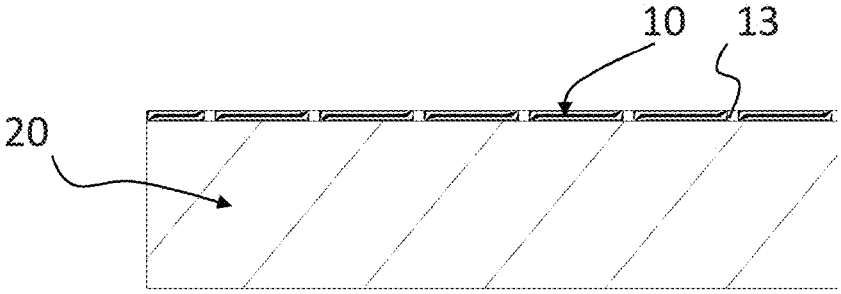
FIG. 15 depicts an enlarged view of details of one particular way of executing the alternative form of the second embodiment of the invention of FIG. 11.

Such layers of constant or variable thicknesses may be subjected to a structuration. By way of example, FIG. 15 depicts one particular way of executing a horology component according to the particular alternative form of the second embodiment illustrated in FIG. 11. A structuration 13 based on micro-openings that pass all the way through is produced in this coating in order to encourage or modify, notably to enhance, the transparent nature of the first portion. The coating may for example be perforated using a femtosecond laser, with progressively increasing speeds of travel, in order to create, for example, shading, that the observer may or may not be able to perceive by day. This same horology component by night has a luminous appearance the intensity of which varies according to the aforementioned shading. Here, the structuration takes the form of cylindrical microscopic openings that pass all the way through, with a variable density.

Figure 16:
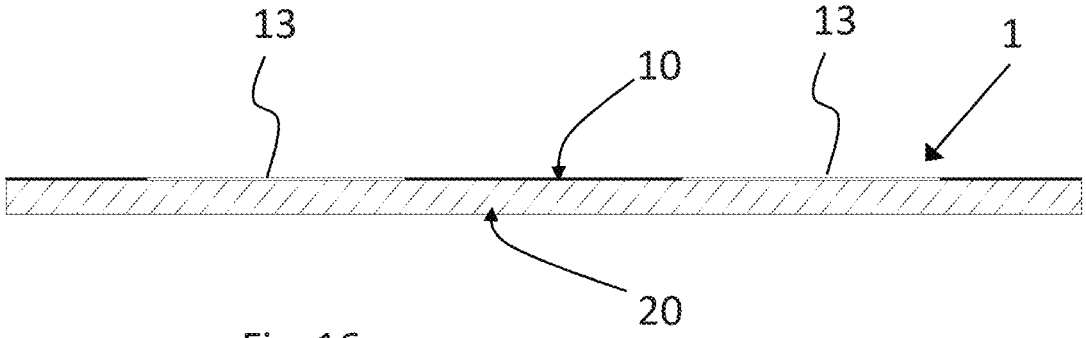
FIGS. 16, 17, 18 depict schematic views in cross section of a versatile horology component according to particular alternative forms of the second embodiment of the invention.

FIG. 16 depicts another particular way of executing a horology component according to the particular alternative form of the second embodiment illustrated in FIG. 11. The first portion comprises macroscopic openings 13 that form a decoration visible by day. All or some of the macroscopic openings may optionally be filled with at least one second coating which may constitute a decoration or inscriptions. Such openings may be achieved by localized deposition, notably using masking, when depositing the coating.

Of course, this structuration 13 may take different forms, such as those notably described in respect of the first embodiment of the invention.

Whatever the execution, a third portion may be interposed between the first and the second portion and may be provided for modifying, or even sublimating, the effects generated by the second portion of said horology component, and therefore modifying the daytime and/or night-time aesthetic of the horology component. This third portion may, for example, take the form of a mask which limits the transmission of light whatever the structuration, or lack of structuration, of the first portion situated above it. This third portion may also take the form of a layer, for example the form of a fluorescent layer, which can be excited by the second portion.

Whatever the embodiment considered, the second portion may have means allowing the horology component to be assembled, notably fixed, inside a timepiece.

Figure 17:
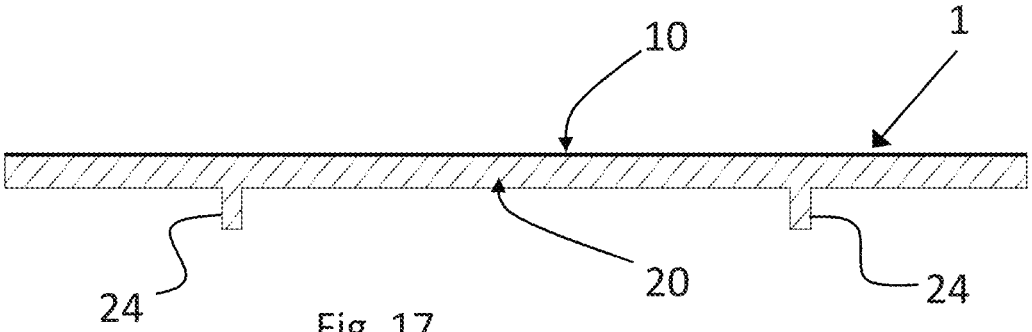

By way of example, FIG. 17 depicts one particular way of executing a horology component according to the second embodiment, in which the second portion 20 has interior extensions 24 for fixing it.

Figure 18:
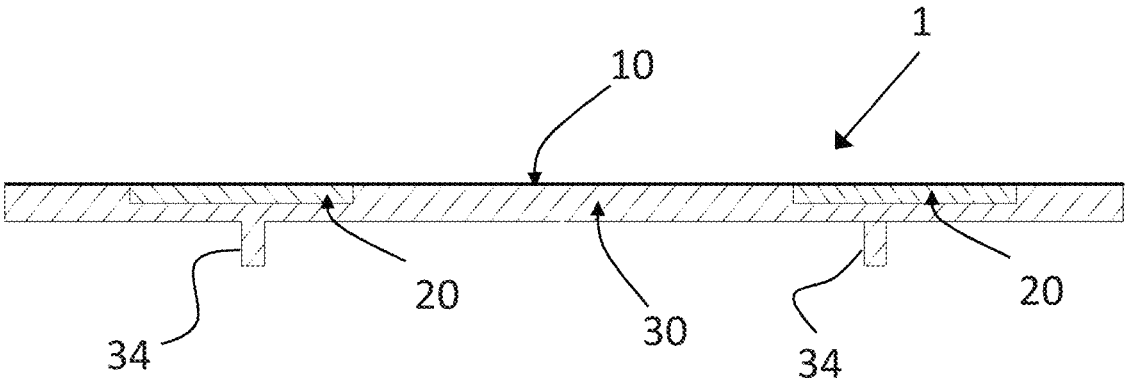

FIG. 18 depicts another particular way of executing a horology component according to the second embodiment. This horology component is made up of a third portion 30 in the form of a massive component acting as a base plate for the horology component and incorporating, for example, legs 34 for fixing to a timepiece, such as to a horology movement. A second portion 20 comprises several distinct and massive parts, made of massive luminescent material, such as luminescent zirconia, included in the hollows in the exterior surface of the third portion 30. The exterior surfaces of the second and third portions are substantially at the same level and are coated with a first portion 10, such as a coating. The second portion 20 may constitute added numerals markers or hour markers or any markers. As an alternative, these added numerals markers or hour markers or any markers may be in relief rather than being in the same plane as the third portion 30. Such markers may for example be added to a dial plate which constitutes the third portion 30. Thus, advantageously, this third portion may act as a support and makes it possible to modify the daytime and/or night-time aesthetic of the horology component.

Whatever the embodiment considered, the horology component may, for example, be a dial, a dial counter, an index (an hour marker, a numeral marker, or any marker), a bezel disk or, more generally, a decorative plate that contributes to the aesthetic of a timepiece. Such a horology component according to the invention may be assembled with any other horology component in order to decorate the component and supplement, for example, a dial of substantially traditional structure rather than on its own forming the dial, as in the particular forms of execution which have been described. Thus, more generally, the invention applies to any object the cladding or decorating of which implements the solution described. The invention also relates to a timepiece, notably a wristwatch, incorporating a versatile horology component according to one embodiment of the invention.

The horology component has been described nonlimitingly hereinabove.

Numerous other executions are conceivable.

Whatever the embodiment considered, other additional elements, such as numerals markers or hour markers or any markers or transfers may be superposed on the first portion, concealing certain zones. Depending on the nature of these additional elements, the luminescence effect may be maintained or eliminated.

It is of course possible to combine the alternative forms of embodiment or the executions described hereinabove. Furthermore, the two portions 10, 20 of the horology component can be superposed only partially. They may occupy any geometry, for example form the entirety of a dial or just a sub-part of a dial, such as numerals markers or hour markers or any markers or counters. In addition, the first portion may comprise one or more zone(s) made of transparent material (s) for which structuration is not required and remains optional, combined with one or more zone(s) made of opaque material, which may or may not include structuration, as described hereinabove.

The invention claimed is:

1. A horology component for a timepiece, wherein the component comprises:

a first portion, and a second portion, the first portion comprising a part that is at least partially transparent and at least partially superposed on top of the second portion, the second portion taking the form of a massive portion comprising a luminescent material distributed through its volume and capable of emitting at least one emission light wave if excited by at least one excitation light wave, the part of the first portion that is at least partially transparent allowing an emission light wave emitted by the second portion to be transmitted at least partially toward an outside of the horology component so that the horology component exhibits at least a first appearance by day and at least one different second appearance by night where the first portion is backlit by an emission light wave emitted by the second portion, and wherein the first portion is in the form of a massive portion and wherein said component comprises an assembly, removable or non-removable, between the first and second portions by bonding, or by a mechanical device, or by crimping, or by capillary adhesion.

2. The horology component as claimed in claim 1, wherein the part of the first portion is translucent, and allows an excitation light wave coming from outside the horology component to be transmitted at least in part to the second portion, but doesn't allow or only allows a part of the second portion to be seen by day.

3. The horology component as claimed in claim 1, wherein the second portion is in the form of a massive structure formed from a material having a fluorescent and/or phosphorescent property.

4. The horology component as claimed in claim 3, wherein the second portion is in the form of a fluorescent and/or phosphorescent ceramic.

5. The horology component as claimed in claim 1, wherein the second portion forms a support for the first portion, and/or wherein the second portion forms a support for the horology component on a timepiece.

6. The horology component as claimed in claim 1, wherein the first portion has a thickness less than or equal to 2 mm inclusive, and/or wherein the second portion has a thickness on average greater than or equal to 0.01 mm, and/or a surface area greater than or equal to 1 $mm^2$.

7. The horology component as claimed in claim 1, wherein the first portion is made of mother-of-pearl; of fossil material; of tortoiseshell; of manganocalcite; of lepidolite; of petrified wood; of coral; of amber; of pearl; of ivory; of metal or of metal alloy; of engineering ceramic based on zirconia and/or alumina, pigmented or otherwise; of gemstone; of mineral; of stone or precious substance of organic origin; of sphalerite; of fluorite; of agate; of alexandrite; of amethyst; of anatase; of aventurine; of chalcedony; of chrysoberyl; of chrysoprase; of citrine; of jasper; of tiger's-eye; of opal; of quartz; of spinel; of aragonite; of azurite; of malachite; of crocoite; of apatite; of lazulite; of turquoise; of aquamarine; of beryl; of tourmaline; of obsidian; or of snowflake obsidian.

8. The horology component as claimed in claim 1, wherein the part of the first portion has a thickness and is made of at least one material so as to be at least partially transparent.

9. The horology component as claimed in claim 1, wherein the first portion has a transparency property that is at least partially homogeneous, or wherein the first portion has a transparency property that is heterogeneous, the first portion comprising parts that are at least partially transparent juxtaposed with parts of different transparencies, or wherein the first portion has a variable thickness.

10. A horology component for a timepiece, wherein the component comprises:

a first portion, and a second portion, the first portion comprising a part that is at least partially transparent and at least partially superposed on top of the second portion, the second portion taking the form of a massive portion comprising a luminescent material distributed through its volume and capable of emitting at least one emission light wave if excited by at least one excitation light wave, the part of the first portion that is at least partially transparent allowing an emission light wave emitted by the second portion to be transmitted at least partially toward an outside of the horology component so that the horology component exhibits at least a first appearance by day and at least one different second appearance by night where the first portion is backlit by an emission light wave emitted by the second portion, and wherein the first portion comprises a structuration comprising at least one selected from the group consisting of openings formed on an exterior surface, openings formed on an interior surface, openings formed in a thickness of the part of the first portion, and an ablation of the part of the first portion, invisible or barely visible to the naked eye by day, the structuration being arranged in at least one selected from the group consisting of the at least partially transparent part and an opaque part of the first portion, so as to modify the transparency of the first portion.

11. The horology component as claimed in claim 10, wherein the first portion comprises a structuration distributed homogeneously.

12. A horology component for a timepiece, wherein the component comprises:

a first portion, and a second portion, the first portion comprising a part that is at least partially transparent and at least partially superposed on top of the second portion, the second portion taking the form of a massive portion comprising a luminescent material distributed through its volume and capable of emitting at least one emission light wave if excited by at least one excitation light wave, the part of the first portion that is at least partially transparent allowing an emission light wave emitted by the second portion to be transmitted at least partially toward an outside of the horology component so that the horology component exhibits at least a first appearance by day and at least one different second appearance by night where the first portion is backlit by an emission light wave emitted by the second portion, and wherein the component consists of the first portion and of the second portion, or wherein the component comprises a third portion arranged on top of or substantially even with the second portion or interposed between the first and second portion.

13. The horology component as claimed in claim 12, wherein the third portion is a mask, selective or otherwise, and/or wherein the third portion comprises a fixing device for fixing the horology component, and/or wherein the third portion supports several distinct and massive parts of the second portion, and/or wherein the third portion contributes to the function of assembling the first and second portions, and/or wherein the third portion comprises optical elements such as optical fibres.

14. The horology component as claimed in claim 1, wherein the component is a dial, a dial counter, an index (an hour marker, a numeral marker, or any marker), a bezel disk, or a decorative plate.

15. A timepiece, wherein the timepiece comprises a horology component as claimed in claim 1.

16. The horology component as claimed in claim 4, wherein the ceramic is a composite ceramic based on yttrium-stabilized zirconia and Dy/Eu-doped strontium aluminate.

17. The horology component as claimed in claim 16, wherein the ceramic is a luminescent zirconia.

18. A horology component for a timepiece, wherein the component comprises:

a first portion, and a second portion, the first portion comprising a part that is at least partially transparent and at least partially superposed on top of the second portion, the second portion taking the form of a massive portion comprising a luminescent material distributed through its volume and capable of emitting at least one emission light wave if excited by at least one excitation light wave, the part of the first portion that is at least partially transparent allowing an emission light wave emitted by the second portion to be transmitted at least partially toward an outside of the horology component so that the horology component exhibits at least a first appearance by day and at least one different second appearance by night where the first portion is backlit by an emission light wave emitted by the second portion, wherein the first portion is in the form of a coating of the second portion, and wherein the coating of the second portion is made of a metal, of a metal alloy, of a polymer, of a lacquer, of an enamel, of a ceramic, of a vitreous ceramic, of a hybrid material, or of a varnish.

19. The horology component as claimed in claim 18, wherein the part of the first portion is translucent, and allows an excitation light wave coming from outside the horology component to be transmitted at least in part to the second portion, but doesn't allow or only allows a part of the second portion to be seen by day.

20. The horology component as claimed in claim 18, wherein the second portion is in the form of a massive structure formed from a material having a fluorescent and/or phosphorescent property.

* * * * *